United States Patent [19]

Sato et al.

[11] 4,428,793

[45] Jan. 31, 1984

[54] PREPARATION METHOD FOR A MICROSCOPIC SPECIMEN AND A DEVICE THEREFOR

[75] Inventors: Satoshi Sato, Tokyo; Hiroshi Takahashi, Kodaira; Tsutomu Nakamura, Tokyo, all of Japan

[73] Assignee: Meisei Electric Co., Ltd., Japan

[21] Appl. No.: 409,129

[22] Filed: Aug. 18, 1982

[30] Foreign Application Priority Data

| | | | |
|---|---|---|---|
| Aug. 25, 1981 | [JP] | Japan | 56-125307[U] |
| Sep. 3, 1981 | [JP] | Japan | 56-138849 |
| Mar. 18, 1982 | [JP] | Japan | 57-38387[U] |

[51] Int. Cl.[3] ..... B65C 9/08; B65H 3/46

[52] U.S. Cl. ..... 156/285; 156/295/570; 156/572; 271/106

[58] Field of Search ..... 156/285, 295, 300, 570, 156/572; 271/106, 107

[56] References Cited

U.S. PATENT DOCUMENTS

| | | | |
|---|---|---|---|
| 2,563,450 | 8/1951 | Battey | 271/106 |
| 3,039,767 | 6/1962 | Stanes | 271/106 |
| 3,362,706 | 1/1968 | Busse | 271/106 |
| 3,669,445 | 6/1972 | Wallis | 271/106 |
| 3,826,485 | 7/1974 | Shindo | 271/106 |
| 4,033,809 | 7/1977 | Tipton | 156/572 |
| 4,097,040 | 6/1978 | Pugh | 271/107 |
| 4,146,414 | 3/1979 | Stormy | 156/295 |
| 4,236,954 | 12/1980 | Edwards | 156/572 |
| 4,248,417 | 2/1981 | Fujimoto | 271/106 |

FOREIGN PATENT DOCUMENTS

| | | | |
|---|---|---|---|
| 54-115871 | 9/1979 | Japan | 271/106 |
| 54-122570 | 9/1979 | Japan | 271/106 |
| 54-122571 | 9/1979 | Japan | 271/106 |

*Primary Examiner*—Jerome W. Massie
*Attorney, Agent, or Firm*—McGlew and Tuttle

[57] ABSTRACT

A method and apparatus for preparing a microscopic specimen by lifting up coverslips in a piled state one by one, comprises a step of means for holding the uppermost coverslip on one spot on its upper surface and pushing the same on another spot on one end portion of its upper surface apart from the holding spot in a longitudinal direction of the coverslip. The holding spot of the coverslip is then lifted and, with a delay time; the pushing spot of the coverslip is lifted so as to bend the coverslip while it is held, within its elastic limit edge of the coverslip is then pushed downwardly to bend the coverslip and cause another coverslip which may be stuck to the bottom of the uppermost coverslip, to drop off. The curvature is then eliminated.

13 Claims, 26 Drawing Figures

PREPARATION METHOD FOR A MICROSCOPIC SPECIMEN AND A DEVICE THEREFOR

BACKGROUND OF THE INVENTION

1. Field of the Invention

The present invention relates to a method of making a microscopic specimen used for pathological examinations, etc. and to a device for making the microscopic specimen, particularly to a method of taking up coverslips, one sheet at a time and a method of sealing a specimen on a slide with a coverslip which has been taken up under said method, as well as to a device for making a microscopic specimen using these methods.

2. Description of Prior Art

When pathological tests are done, for example at hospitals, etc., a number of test materials (test pieces to be examined) are made into the form of a specimen so that they can be observed with a microscope. While a microscopic specimen is normally made by attaching a piece of test material on a slide and covering the same with a coverslip, solvent for removing paraffin used in cutting the test material into small pieces or a sealing agent to seal the test material between the slide and the coverslip generally produce poisonous vaporous gas. Because of this, a device having at least its test material sealing process automated is used when a number of such microscopic specimens are to be prepared.

In such a device a conventional take out mechanism for coverslips, a transferring mechanism, and a sealing mechanism for test material are made in the following manner. The device is made of a mechanism in which slits with a thickness corresponding to the thickness of a coverslip, are provided at a wall surface of a receptacle for housing coverslips in a piled up state. To take out coverslips one by one from said slits, reciprocating movement of a plate piece having the same thickness as that of the coverslips is used or rotating movement of rollers frictionally contacting the coverslips is used. A transferring mechanism to place the coverslip taken out one by one on a vertically movable table stand and to transport the table stand to a prescribed position is also provided. The device also includes a sealing mechanism to discharge a liquid sealing and adhesive agent (hereinafter called as mountant) to seal and fix in place the test material from an upper direction onto a surface of said coverslip and means to then transfer a slide with the test material to be examined stuck thereon over to a position above said coverslip and for fixing the same. Thereafter the table stand with said coverslip placed thereon is moved in a vertical direction, thereby sealing and fixing the test material between said coverslip and said slide.

Since the take out mechanism for coverslips, the transfer mechanism and the test material fixing mechanism are so arranged as to be independent from each other in a conventional test material fixing mechanism explained above, it has a shortcoming that not only does the structure thereof becomes complicated but also an interrelating control between each mechanism becomes complicated.

Also as each of the mechanisms is examined, first the coverslip take out mechanism is a mechanism to push out the lower-most coverslip out of the number of coverslips piled up slidingly over a plane of the other coverslip (the coverslip piled up in direct contact with an upper surface of the coverslip being taken out), therefore in case the coverslips are tightly stuck to each other for example because of moisture, etc., it becomes impossible to take out the coverslip one by one due to a frictional force of said sticking, or if a trial is made to forcibly take out the same (if a trial is made to take out the same with greater power than the tightly stuck frictional force) such force may break the coverslip.

Also, a mechanism to seal the test material will inevitably move the slide or the coverslip in a direction so that they approach each other while being maintained parallel to each other when transferring the coverslip for sealing the test material. Therefore, it is unavoidable that air bubbles mix into the test material or in the neighbourhood of the same, and such air bubbles could cause an erroneous judgement in examining the test material. Also when the prepared specimen is to be retained in file for a long period of time, the sealed air bubbles could cause oxidation of the test material within the specimen, thus it is undesirable.

The present invention is made to solve the above-mentioned problems in the prior art, and it is the object of the present invention to obtain a test material fixing mechanism in which an important part of a take out mechanism of for coverslips can be used as a transfer mechanism and as a part of a test material sealing mechanism so that the mechanism is simplified and at the same time coverslips can be surely taken out one by one without damaging the same and a preparation of a microscopic specimen can be made without air bubbles being mixed in the test material or in the neighbourhood of the same.

SUMMARY OF THE INVENTION

In order to achieve the above object, in the present invention such a method is employed for taking out coverslips, a number of which are piled up, one by one, that a coverslip in the uppermost position is lifted up by adherently holding the same by adhesion means and at the same time the coverslip is pushed by pushing means at another position than the holding position. The coverslip is then bent within a limit of elasticity thereof in a process of lifting up the covering so that the next coverslip which may have been stuck to the coverslip being taken out by moisture, etc. is separated Sealing and firing the test material between the slide and the coverslip wherein the coverslip, having been taken out one by one as mentioned above, is held in a slanted manner by the adhesion means and the pushing means and a slide, which has test material attached thereon and has mountant dropped thereon at an end part of the plane at which the test material is to be sealed, is positioned underneath the above-mentioned coverslip held in a slanted manner. The coverslip is then made to descend vertically downwardly while holding the same in the slanted manner thereby bending said coverslip over the slide so that said coverslip is pushedly made to contact said slide in a manner which gradually eliminates the curvature of the coverslip thereby pushing out air bubbles which tend to be mixed in. The invention is also drawn to a device for making a microscopic specimen using these methods as shown below. That is, the device comprises adhesion means to hold and transfer a coverslip, first pushing means positioned at an end part of the coverslip in relation to a position of the adhesion means, to hold the coverslip in a slanted state as it is transferred then to push the same as the test material is sealed, and second pushing means which is placed at a position corresponding to a fore end part of the coverslip being at the opposite end thereof with respect to the position of the first pushing means with the adhesion means located in the middle of these two pushing means to pushingly bend the coverslip which has been adherently held by the adhesion means in cooperation with the first pushing means when the coverslips are taken out one by one, wherein the adhesion means and the two kinds of pushing means engage in the taking out process of the coverslip while the adhesion means and the first pushing means take care of the transferring process of the coverslip and the sealing process of the test material.

DETAILED DESCRIPTION OF THE INVENTION

Figure 1:
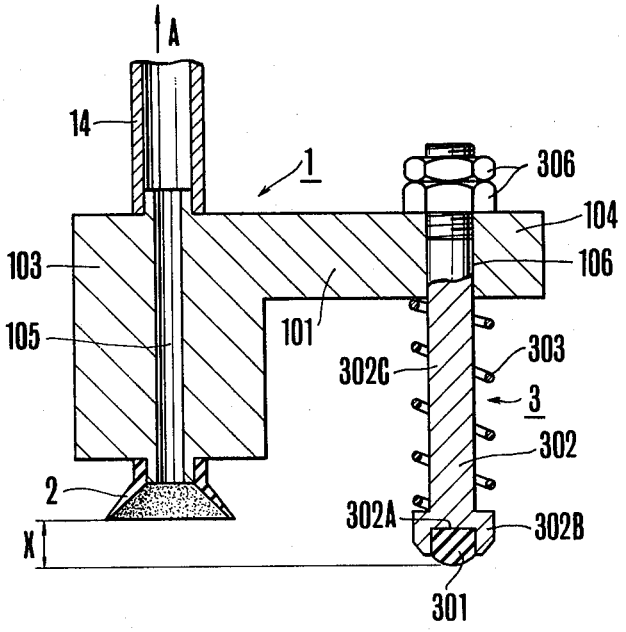
FIG. 1 is a cross-sectional view to show an important part of a mechanism to realize the method of the present invention.
Figure 2:
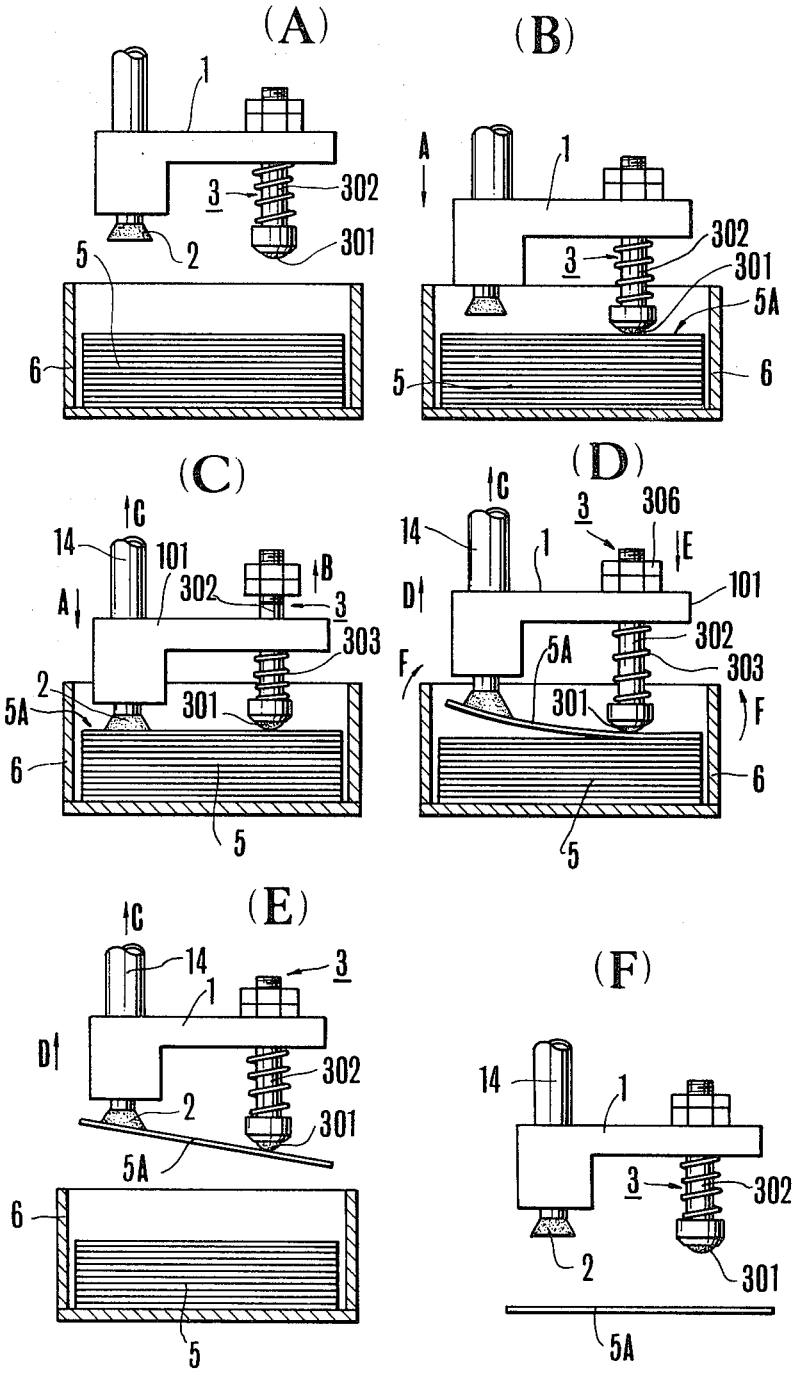
FIGS. 2(A) to (F) are schematic drawings to show an operating process in sequence when the mechanism shown in FIG. 1 is used as a take out mechanism for taking out coverslips.
Figure 3:
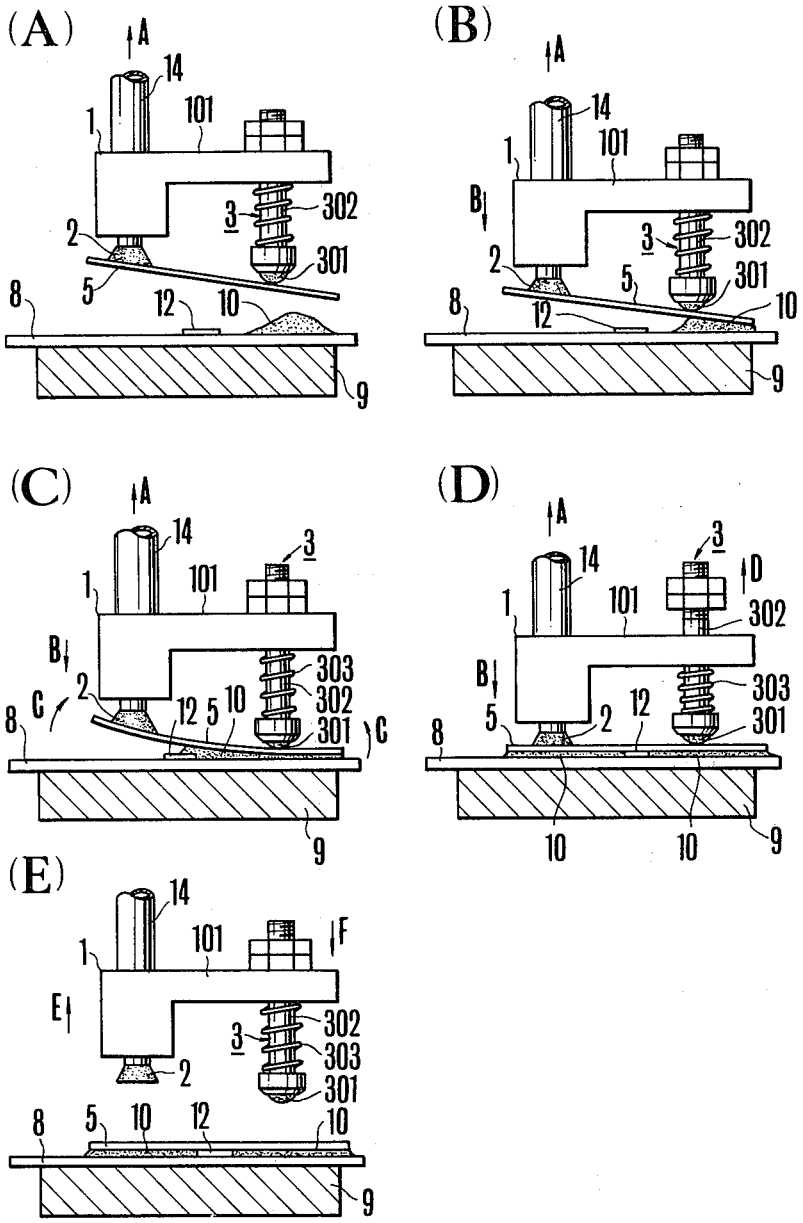
FIGS. 3(A) to (E) are drawings to show an operational process in sequence when the mechanism shown in FIG. 1 is used as a sealing and fixing mechanism for test material.

The present invention will be described in more detail with reference to the accompanying drawings showing preferred embodiments thereof.

First, description will be made on the method of taking out coverslips according to the present invention referring to FIG. 1 and FIGS. 2(A) to (F).

In FIG. 1 and FIGS. 2(A) to (F), what is shown as 1 is a main supporting body or member, and 2 represents adhesion means, while 3 is a pushing mechanism (hereinafter called a pushing part). What is shown as 5 are coverslips and 6 is a housing receptacle for the coverslips 5, while 14 is an air vent tube. In the main supporting body or member 1, what is shown as 101 is a supporting body or member, 103 is a mounting part for the adhesion means or holding mechanism, 104 is a mounting part for the pushing mechanism, 105 is an air suction hole, and 106 is a perforated hole for a pushing bar. In the pushing part 3, what is shown as 301 is a pushing body, 302 is a pushing bar, 303 is a spring, and 306 is a nut.

In the main supporting body 1, the holding mechanism mounting part 103 to which the structure constituting the adherently holding mechanism for coverslips 5 (the adhesion means 2 and the tube 14) is mounted, and the pushing mechanism mounting part 104, to which the structure constituting the pushing part 3 (pushing bar 302, the pushing body 301, the spring 303, and the nut 306) is mounted in a manner being movable by an elastical pressing, are combinedly constituted.

The adherently holding mechanism mounting part 103 has the air suction hole 105 provided in a perforating manner, and the pushing mechanism mounting part 104 has the perforated hole 106 for the pushing bar provided at its center in a perforated manner.

The adhesion means 2 is made of a cup shaped member (hereinafter called as an adhering cup) formed with soft, elastic material such as silicon rubber into a hollow circular truncated conical shape.

The tube 14 is formed with a member which will not be easily collapsed and has a flexibility such as nylon tube.

The pushing bar 302 consists of a sliding pillar part 302C having an outer diameter but allows it to be movably insertable into the perforated hole 106 for pushing bar 302 in the supporting body 101, and a step formed part 302B of a cylindrical shape formed to have a larger outer diameter than the outer diameter of the sliding pillar part 302C and to have a pushing body inserting part 302A of a concave shape at its center, wherein said pushing bar 302 has threads formed at a fore end part at the opposite end against said step formed part 302B.

The pushing body 301 is formed with relatively hard rubber, etc. and is fixed insertedly into the pushing body inserting part 302A, wherein the body 301 has its central part swelling up in a bulbous shape and protruding from a fore end of the step formed part 302B.

The spring 303 is made of a coil spring having an inside diameter being larger than the outer diameter of the sliding pillar part 302C of the pushing bar 302 and being smaller than an outer diameter of step formed part 302B.

The nut 306 is made of for example double nuts and is threaded into the fore end part (the threaded part) of the pushing bar 302 and is fixed thereat.

The adherently holding mechanism mounting part 103 of the supporting body 101 has the tube 14 at an upper opening part of its air suction hole 105 and has the adhering cup 2 at a lower opening part thereof being fittingly fixed respectively by a coupling part of an air-tight manner (in a manner not allowing air to leak). Although not being shown in the drawing the other end of the tube 14 is connected through opening and closing means such as an electromagnetic valve to a vacuum pump (a pump which can produce such level of vacuum that cup 2 is able to adhere to coverslips but not damage then).

The pushing part 3 is mounted to the pushing mechanism mounting part 104 in the following manner. After placing the spring 303 around the sliding pillar part 302C of the pushing bar 302, the pillar part 302C is inserted into the perforated hole 106 for inserting the pushing bar 302 from its fore end part, then the nut 306 is threaded thereon and is fixed thereto.

The nut 306 can be fixed at any desired position at an upper fore part of the pushing bar 302 so that a protruding length of the pushing body 301, that is a distance X between a fore end of the pushing body 301 and an adhering plane of the adhering cup 2, can be adjusted.

This distance X is set to such length that a curvature of the coverslip 5 when said coverslip 5 is bent will not exceed a limit of elasticity of said coverslip 5.

Next, an operation of this example shall be explained with reference to FIGS. 2(A) to (F).

At a stage of taking out one sheet of the coverslip 5 in a process of preparing a microscope specimen, the housing receptacle 6 or the main supporting body 1 is shifted so that the housing receptacle 6 is positioned exactly beneath the main supporting body 1 as shown in FIG. 2(A). Under this state, the upper opening part of the housing receptacle 6 faces the adhering cup 2 and the pushing body 301.

Next, the main supporting body 1 descends in the direction of an arrow A (while the housing receptacle 6 could be made to ascend in the opposite direction of the arrow A, (the explanation to be made below shall be based on an assumption that the main supporting body 1 is the one to move) as shown in FIG. 2(B), and the pushing body 301 first comes in contact with the uppermost coverslip 5A out of the coverslips piled up within the housing receptacle 6.

Next, as the main supporting body 1 further descends in the direction of arrow A, the pushing body 301 relatively ascends in the direction of an arrow B with respect to the supporting body 101 against the elastic force of the spring 303 as shown in FIG. 2(C), then the adhering cup 2 comes in contact with one end of the uppermost coverslip 5A. When said state is attained an electromagnetic valve (not shown in the drawing) installed to the tube 14 opens towards a vacuum pump (not shown in the drawing) and air within the adhering cup 2 is withdrawn in the direction of an arrow C by the vacuum pump so that the adhering cup 2 adheres to the uppermost coverslip 5A at its one end. As the adhering cup 2 is made of soft elastic member, the coverslip 5A will be surely adhered and held by the adhering cup 2.

When the coverslip 5A is adhered to the adhering cup 2, the main supporting body 1 is controlled so as to ascend in the direction of an arrow D as shown in FIG. 2(D). Here an action to withdraw air in the direction of the arrow C through the tube 14 still continues in the process shown in FIG. 2(D) and in a process shown in FIG. 2(E) to be described below.

Elasticity (restoring power) of the spring 303 is set to be stronger than that of the coverslips 5 in the bending direction, and when the main supporting body 1 ascends in the direction of the arrow D the pushing bar 302 relatively descends in the direction of the arrow E with respect to the supporting body 1 by the restoring power of the spring 303, then the uppermost coverslip 5A bends in the direction of an arrow F while being adherently held by the adhering cup 2 in a cantilever manner. This bending action is done smoothly because the adhering cup 2 is made of soft, elastic member. Also, even when the uppermost coverslip 5A tightly adheres to a next coverslip by moisture, etc., a slight amount of slip will take place between said two sheets of coverslips by the bending, thus the uppermost coverslip 5A only is separated without fail. Further, since an amount of curvature of the coverslip 5A is restricted to within the limit of elasticity thereof by a fixing position of the nut 306, the coverslip 5A will not have a plastic deformation or a breakage in this process.

When the uppermost coverslip 5A is separated from the other coverslips by the main supporting body 1 and is adherently held thereto, the main supporting body 1 further ascends in the direction of the arrow D as shown in FIG. 2(E), and the coverslip 5A will be taken out of the housing receptacle 6 while being held to the adhering cup 2 in a cantilever style. The coverslip 5A at this time will have its warp disappear by its own restoring power.

And the main supporting body 1 shifts horizontally to a place to supply the coverslip while adherently holding the coverslip 5A, then descends.

Here the electromagnetic valve is changed over from the vaccum pump side to an atmospheric air side thereby permitting air flow into the adhering cup 2 through the tube 14 to release the adhesion by the adhering cup 2, thus the coverslip 5A is dropped as shown in FIG. 2(F) and is taken out to a prescribed position.

Next, explanations will be made on a method of sealing and fixing test material according to the present invention with reference to FIG. 1 and FIGS. 3(A) to (E).

In FIGS. 3(A) to (E), what is shown as 8 is a slide, 9 is a table stand for the slide 8, and 10 is mountant, while 12 is a test material (test piece being examined) to be sealed. The other numbers and marks are the same as in FIG. 1.

An arrangement of a sealing and fixing mechanism of test material is same as that of the above-mentioned coverslip take out mechanism except that the housing receptacle 6 for the coverslips 5 in the coverslip take out mechanism is replaced with the table stand 9 for the slide 8, thus the arrangement of the sealing and fixing mechanism for test material may be easily understood by the arrangement explained by FIG. 1.

In an initial stage of the process shown in FIGS. 3(A) to (E), the test material 12 which is to become a specimen is attached to an upper plane of the slide 8 and is stained, then the slide 8 with the test material 12 thereon is placed on the table stand 9 and held in place thereat in a state that entire surface thereof is wet with solvent for example xylene (not shown in the drawing). Thereafter mountant 10 is dropped onto an upper plane of the slide 8 near a part where the test material 12 is attached. The mountant 10 is to adhere the coverslips 5 with the slide 8 and at the same time to shield the test material 12 from ambient air for preventing deterioration of said test material 12, and is liquid being made by dissolving adhesive with for example xylene (e.g. pinene type resin mountant).

Also in the initial stage of the process the above-mentioned taking out of the coverslip 5 is done and said coverslip 5 is held in a slanted manner by the holding with the adhering cup 2 and the pushing by the pushing part 3 and is so controlled as being shifted to a position above the slide 8. That is, when the above-mentioned coverslip take out process is immediately shifted to the sealing process of the test material 12, an operation proceeds from the process of FIG. 2(E) to the process of FIG. 3(A) without going through the process of FIG. 2(F). Concerning the holding of the coverslip 5 in a slanted manner, since the adhering cup 2 is formed with elastic member, even when the coverslip 5 is made to slant while being adhered to the adhering cup 2, the adhering cup 2 will be deformed following the slanting of the coverslip 5 thus the coverslip 5 being adherently held in place will not drop off and the coverslip 5 will not be damaged. Also in each process shown in FIGS. 3(B) to (D) to be described later, the adhering cup 2 will effectively follow a change in shape of the coverslip 5 and continues to adherently hold the coverslip 5.

When the above-mentioned two processes are completed either simultaneously or separately, the table stand 9 or the main supporting body 1 shifts and the slide 8 and the coverslip 5 face to each other as shown in FIG. 3(A). At this time, a shifting control is so made that a part on the slide 8 at which the mountant 10 is dropped is made to face an end part at a lower plane of the coverslip 5, wherein the table stand 9 is fixed in place so that it will not be shaken. Also during the processes from FIG. 3(A) to FIG. 3(D), air within the adhering cup 2 is withdrawn by a vacuum pump to the direction of the arrow A through the tube 14 and the coverslip 5 continues to be held to the main supporting body 1.

In a next process, the main supporting body 1 descends in the direction of the arrow B by the adhering cup 2 and the pushing bar 302 (the pushing body 301) while adherently holding the coverslip 5 in a slanted manner as shown in FIG. 3(B) (here, although the table stand 9 may be made to ascend to the opposite direction of the arrow B, explanations hereafter will be made for a case the main supporting body 1 moves downwards), and the lower end part of the coverslip 5 comes in contact with the slide 8, then the mountant 10 spreads therebetween. At this moment, the inclination angle of the coverslip 5 is same as the inclination angle in the process shown in FIG. 3(A).

As the main supporting body 1 further descends to the direction of the arrow B, since the elasticity of the spring 303 imparting elastic pressure to the pushing bar 302 is set larger than the elasticity of the coverslip 5, the coverslip 5 will have its one end adherently held by the adhering cup 2 and at the same time will have the other end thereof pushed by the pushing body 301 as shown in FIG. 3(C) and is bent to the direction of the arrow C. This bending will become largest instantaneously when the pushed part of the coverslip 5 and the slide 8 adhere to each other sandwiching the mountant 10 therebetween. And at this time the mountant 10 is pushed out and spreads towards the test material 12, then comes to a state to have the test material 12 soaked therewith.

Next, when the main supporting body 1 further descends towards the direction of the arrow B the curvature of the coverslip 5 gradually becomes smaller, and the mountant 10 further spreads between the slide 8 and the coverslip 5. The descending of the main supporting body 1 towards the direction of arrow B continues, as shown in FIG. 3(D) until the portion of the coverslip 5 being held by the adhering cup 2 is adhered to the slide 8 sandwiching the mountant 10 therebetween, then as the state shown in FIG. 3(D) is reached the curvature of the coverslip 5 will be reduced to zero. Also, during the processes from FIG. 3(C) to FIG. 3(D) the pushing bar 302 compresses the spring 303 but is retained at the same position. That means the pushing bar 302 relatively ascends in the direction of the arrow D with respect to the main supporting body 1.

As has been explained above, since a sealing process is done gradually as the curvature of the coverslip 5 is being reduced for restoring an original shape of the same in the fixing and sealing method for the test material in the present invention, air between the slide 8 and the coverslip 5 is pushed outside by the restoring power (elasticity) of the coverslip 5.

When the state shown in FIG. 3(D) is secured, the mountant 10 is spread all over and fills the space between the coverslip 5 and the slide 8, and the test material 12 is sealed by the mountant 10 between the coverslip 5 and the slide 8. When the electromagnetic valve not being shown is changed over from the vacuum pump side to an atmospheric air side upon completion of the process till FIG. 3(D), air flows into the adhering cup 2 through the tube 14 and the adherent holding of the coverslip 5 by the adhering cup 2 will be released. Here, some amount of air may be blown into the adhering cup 2 through the tube 14 in order to insure the separation of the coverslip 5 from the adhering cup 2. When the holding of the coverslip 5 by the main supporting body 1 is released, the body 1 ascends vertically towards the direction of arrow E as shown in FIG. 3(E) and stops there. The pushing bar 302 returns to the direction of arrow F against the supporting body 101 by the restoring power of the spring 303, thus the main supporting body 1 returns to a state before holding the coverslip 5.

Next, explanations shall be made on a device to prepare a microscopic specimen which employs the above-explained taking out method for a coverslip and a sealing and fixing method of test material referring to FIGS. 4 to 7(A)-(K).

In FIGS. 4 to 7(A)-(K), what is shown as 1 is a main supporting body, 2 is an adherently holding mechanism (hereinafter called as an adhering part), 3 is a first pushing mechanism (hereinafter called as a first pushing part), 4 is a second pushing mechanism (hereinafter called as a second pushing part), 5 are coverslips, 6 is a housing receptacle for the coverslips, 7 is a guide slot to determine a height of the second pushing cart 4, and 8 is a slide. What is shown as 9 is a table stand for the slide 8, and 10 is mountant, while 11 is solvent (for example xylene), and 12 is test material while 13 is a base stand, and 14 is a tube.

In the main supporting body 1, what is shown as 101 is a supporting body, and 102 are bearings. In the adhering part 2, what is shown as 201 is an adhering cup, and 202 is a tube, while 203 is a spring, 204 is a rotation stop block, and 205 is a screw. In the first pushing part 3, what is shown as 301 is a pushing body, 302 is a pushing bar, 303 is a spring, 304 is a rotation stop block, and 305 is a screw. In the second pushing part 4, what is shown as 401 is a pushing body, 402 is a pushing bar, 403 is a stop block, 404 is a nut, and 405 is a guide roller.

Figure 4:
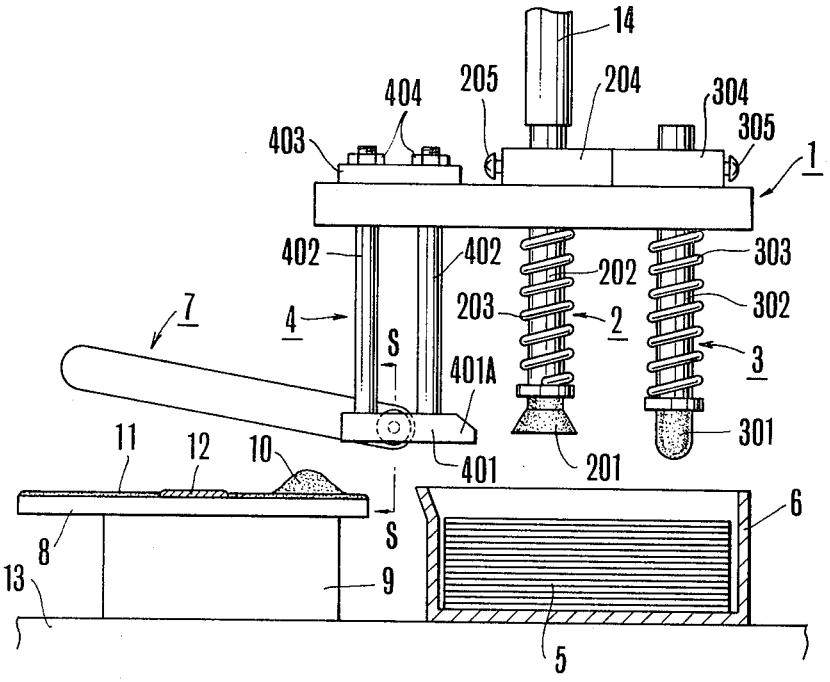
FIG. 4 is a structural drawing to show an example of a microscopic specimen preparing device according to the present invention.
Figure 6:
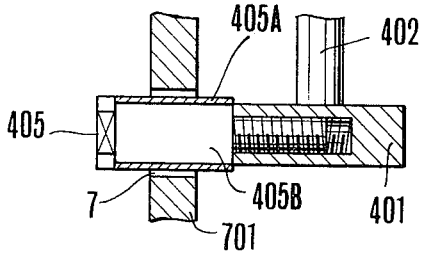
FIG. 6 is a cross-sectional view taken along a line S—S in FIG. 4.
Figure 5:
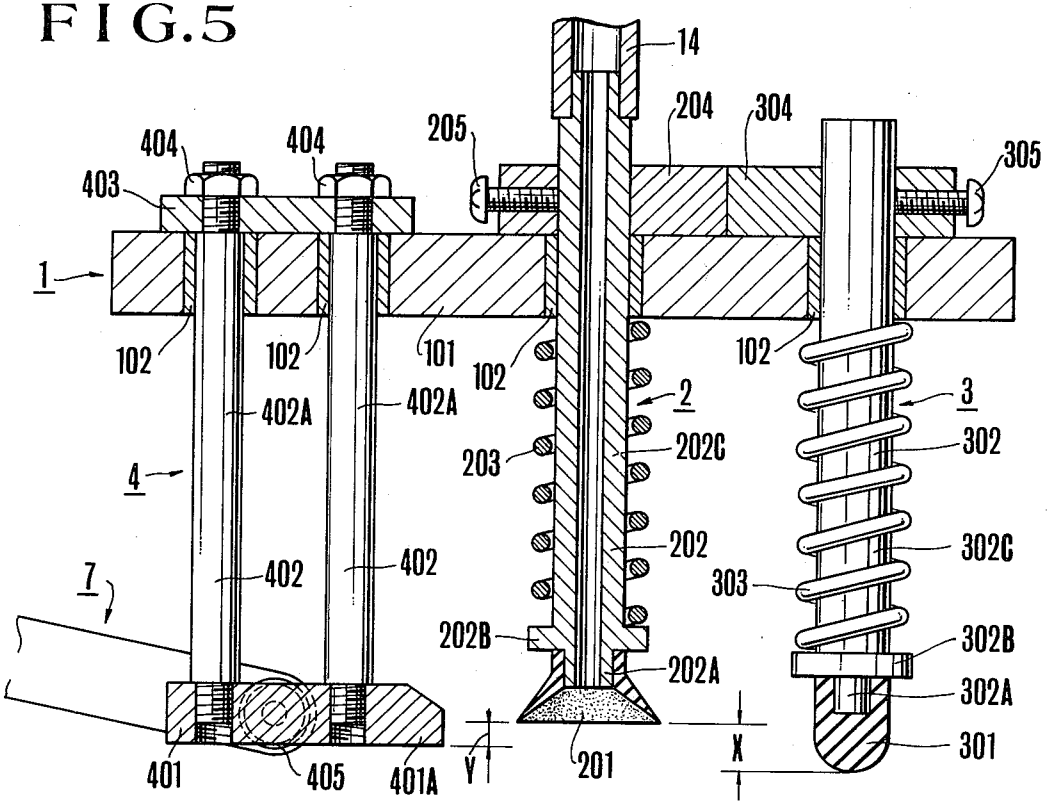
FIG. 5 is a cross-sectional view to show an important part of what is shown in FIG. 4.
Figure 7:
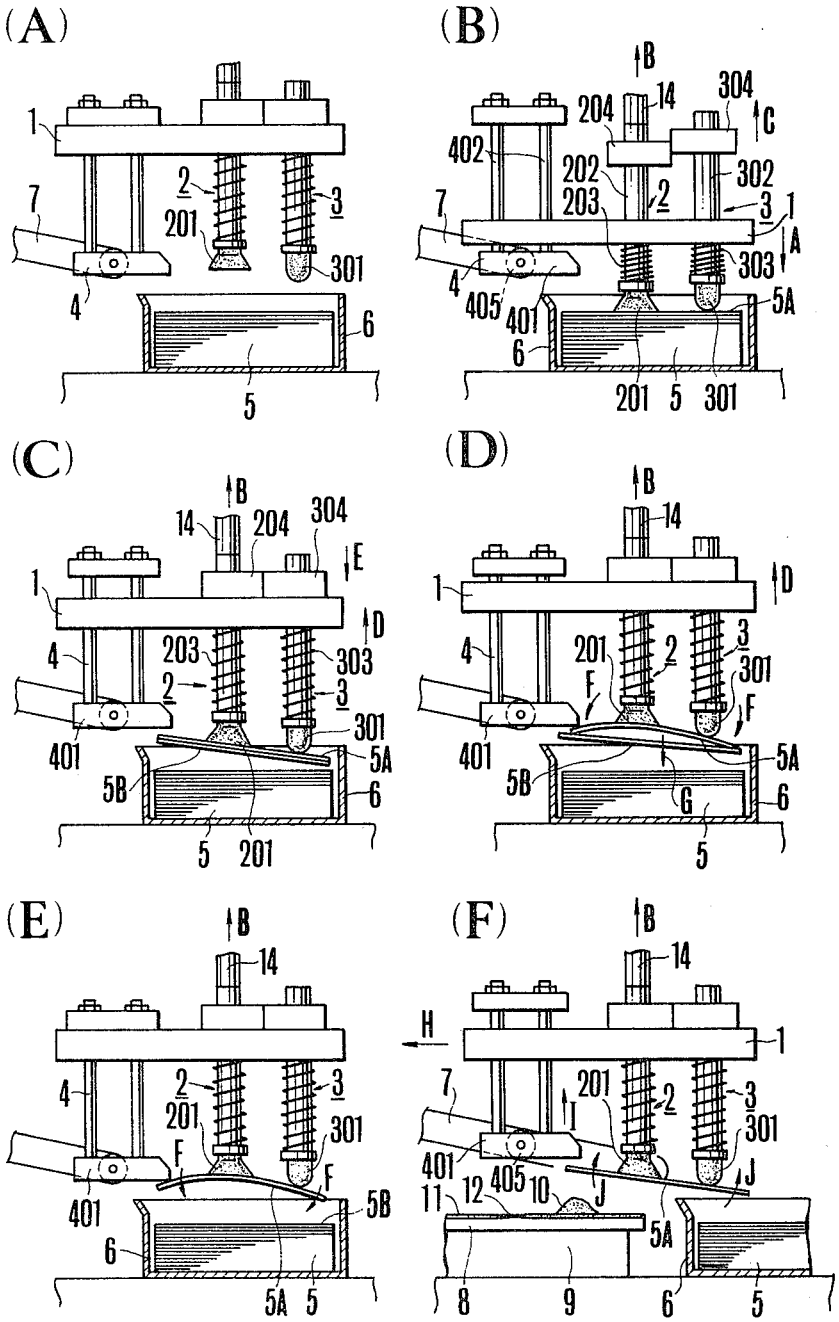
FIGS. 7(A) to (K) are drawings to show an operational procedure of the microscopic specimen preparing device shown in FIG. 4.
Figure 7:
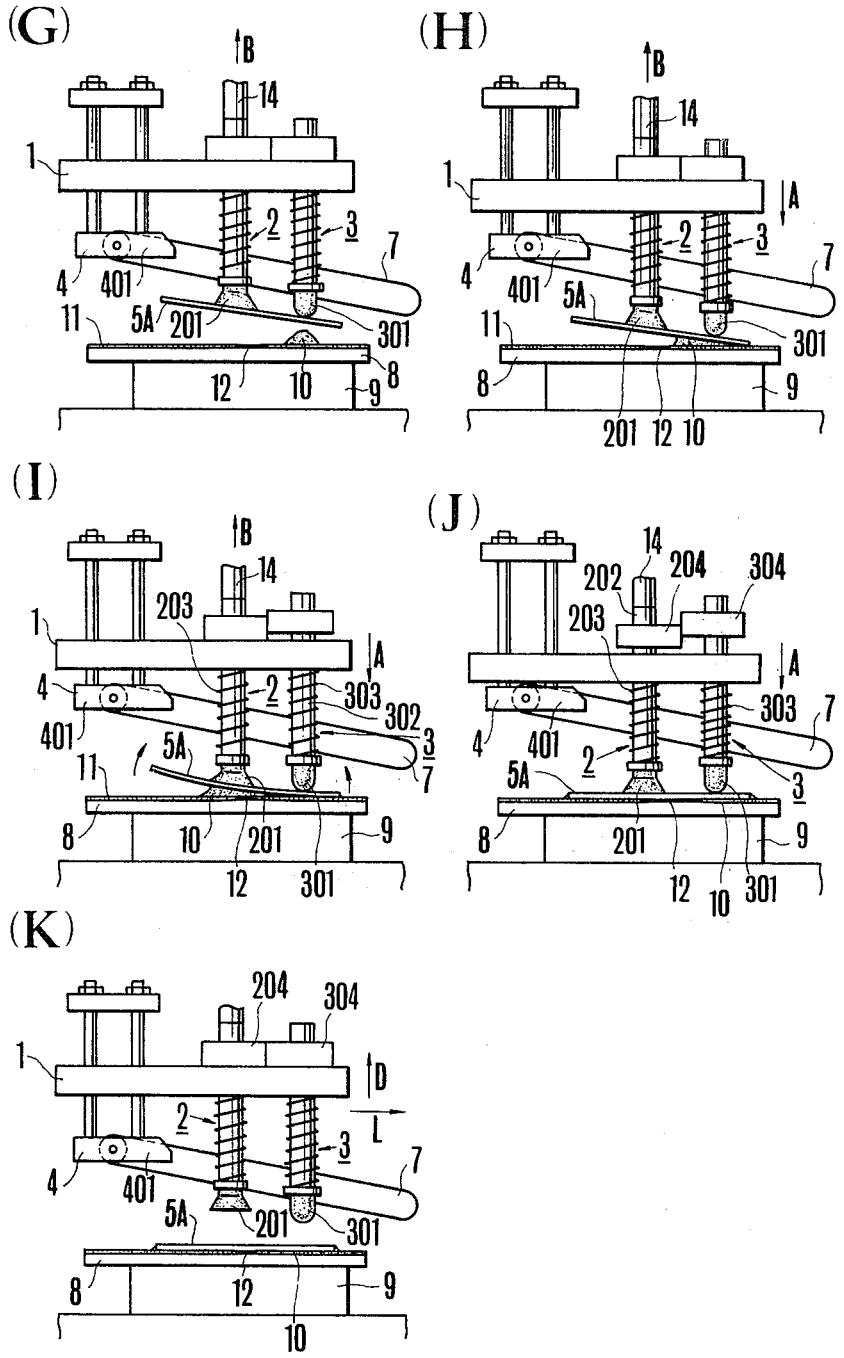

First, explanations shall be made on a structure of each part referring to FIG. 4 to FIG. 6. In the main supporting body 1, the supporting body 101 supports the adhering part 2, the first pushing part 3 and the second pushing part 4 in a movable state, and is made so as to be controlled to move itself to up and down as well as left and right directions. Also, in the supporting body 101, bearings 102 such as oilness bearing are pressedly fixed at supporting parts of the above-mentioned adhering part 2, the first pushing part 3 and the second pushing bar 4, and each bearing 102 receives the tube 202 of the adhering part 2, the pushing bar 302 of the first pushing part 3, and the pushing bar 402 of the second pushing bar of the second pushing part 4, respectively, so that the adhering part 2, the first pushing part 3 and the second pushing part 4 are in a state being slidable in up and down directions.

In the adhering part 2, the adhering cup 201 is formed in a hollow and approximately circular truncated conical shape with soft elastic material such as silicon rubber as in the above-mentioned case. The tube 202 is made of material difficult to be deformed like stainless steel as an example and has its axial center formed hollow to allow air to pass therethrough, and the above-mentioned adhering cup 201 is insertedly fixed to an adhering cup insertion part 202A at a lower fore end part in an airtight manner, and a step shape part 202B is formed for an entire circumference immediately above said adhering cup insertion part 202A, and a spring 203 is inserted between said step shape part 202B and the supporting body 101 around a sliding pillar part 202C, wherein the sliding pillar part 202C is pressedly biased downwards by said spring 203. Further such portion of the tube 202 as protruding out of the supporting body 101 has the rotation stop block 204 fixed thereat by the screw 205, and said rotation stop block 204 is to prevent the tube 202 from dropping off from the supporting body 101 and the rotation. That is, the rotation stop block 204 is formed in a rectangular parallelepiped and has a hole provided from its top plane to its bottom plane through which the tube 202 goes through, and a screw hole for the screw 205 is provided in a direction perpendicular to said perforated hole, so that the block 204 is fixed to the tube 202 by the screw 205 as mentioned above, wherein said block 204 contacts side by side with the rotation stop block 304 for the first pushing part 3 to be described below, thereby being prevented from a rotation, mutually working with each other (mutually working with each other between the adhering part 2 and the first pushing part 3), also the bottom plane abuts on the supporting body 101, thus preventing the tube 202 from being dropped off.

And the tube 14 formed in a soft flexible manner and in an uncollapsible manner is insertedly fixed in an airtight manner above the tube 202 (an end without the adhering cup 201 installed thereat), wherein a vacuum pump (which can create such level of vacuum as being able to adherently hold the coverslip 5 without damaging the same) is connected to an end of said tube 14 through an opening and closing means such as an electromagnetic valve as in the above-mentioned case.

In the first pushing part 3, the pushing body 301 is formed with material being slightly softer than metal such as polypropyrene resin in a cylindrical shape having smaller width or diameter than a width of the coverslip 5 with its fore end formed in a semi-circular shape, and a circular hole is provided at the other end of the pushing body 301 than said fore end part with such inner diameter as allowing a pushing body insertion part 302A formed at a lower fore end part of the pushing bar 302 to be pressed thereinto.

The pushing bar 302 is made of hard material such as stainless steel, and the pushing body insertion part 302A in a projection shape is provided at the lower fore end part, onto which the above-mentioned pushing body 301 is pressedly fitted around. Also, a step shape part 302B is formed around the bar 302 just above said pushing body insertion part 302A for an entire circumference, and the spring 303 is inserted at a sliding pillar part 302C in a similar structure as in the adhering part 2.

And the rotation stop block 304 having similar structure as that of the rotation stop block 204 of the adhering part 2 is fixed in a same method at a part of the pushing bar 302 projecting out of the supporting body 101 of the pushing bar 302, to prevent the pushing bar 302 from dropping off the supporting body 101 and from a rotation of itself, by a same mechanism as in the case of the adhering part 2.

In the second pushing part 4, the pushing body 401 is formed with for example polypropyrene resin and at least a lower plane of a fore end part 401A (a part to push the coverslip 5) is made to have a horizontal plane, and the pushing body 401 is so supported as allowing it to make parallel movements in up and down directions to the main supporting body 1 by two pushing bars 402. And said fore end part 401A is so located as to face one end part of the coverslips 5 within the housing receptacle 6, and a guide roller 405 is provided in the direction of depth in the drawing at about central part of the pushing body 401.

The guide roller 405 is made by fitting a roller 405A in a freely rotatable manner around a roller shaft 405B of a stepped pillar shape being fixed at the pushing body 401, and the roller part 405A is inserted into a guide slot 7 in a freely slidable manner.

The pushing bars 402 are formed with stainless steel bars of a pillar shape as an example and have threads formed at their top and bottom end parts, wherein the above-mentioned pushing body 401 is fixed at the bottom ends of said two pushing bars 402 having said arrangement by screwing said bars themselves, and the sliding pillar parts 402A are made to go through the bearings 102 of the supporting body 101, then a plate form stop block 403 is fixed by a nut 404 at a top fore end of the pushing bar 402, to prevent the second pushing part 4 from dropping off the main supporting body 1.

The guide slot 7 is formed on a structural body having an unchanging positional relationship with the base stand 13, for example a wall plane 701 being erected vertically upwards from the base stand 13 as an example, having an inclination to ascend to left hand direction in the drawing.

By the above-mentioned setup, the pushing body 401 will not move against the up and down movements of the main supporting body 1, but will make a parallel movement in an up or down direction against the left and right direction movements of the main supporting body 1.

The housing receptacle 6 is made of a box shape body having an inside dimension large enough to house the coverslips 5 and an upper part being opened, and said upper open part is made with a widened opening shape so that the dropping coverslip 5 can be properly placed into the housing receptacle 6. If this housing receptacle 6 is made of transparent member, an inside thereof can be seen and is convenient.

The table stand 9 for the slide 8 is formed in an appropriate shape with its upper plane made into a horizontal surface, and said upper plane to place the slide 8 thereon has its material and shape made so as not to damage the slide 8 (for example the material is to have somewhat smaller hardness than that of the slide and circumferential edges of the upper plane to place the slide thereon are somewhat rounded off, etc.).

The above-mentioned housing receptacle 6 and the table stand 9 are fixed to the base stand 13 (in practice the housing receptacle 6 and the table stand 9 are fixed to separate base stands respectively so that they can make different movements for other purposes than the test material sealing process), and said base stand 13 may be made to shift to up and down directions as well as the left and right directions instead of shifting the above-mentioned main supporting body 1 to up and down as well as left and right directions, further such arrangement may be employed that one of them (the main supporting body 1 or the base stand 13) is shifted to up and down directions while the other one (the base stand 13 or the main supporting body 1) is shifted to left and right directions. In this case, the guide slot 7 will have its positional relationship unchanged against the base stand 13, further, since the housing receptacle 6 and the table stand 9 are fixed to the base stand 13, the housing receptacle 6, the table stand 9 and the guide slot 7 shift along with the shifting of the base stand 13 while their mutual position relationships remain unchanged (wherein a shifting time, shifting direction and shifting amount are the same as those of the base stand 13).

Also, in an unoperating state the fore end of the pushing body 301 of the first pushing body 3 and the fore end (the fore end part 401A) of the pushing body 401 of the second pushing part 4 are set so as to protrude towards the direction of the housing receptacle 6 over the adhering plane of the adhering cup 201. Here their respective protruding lengths X and Y are set at optimum values in view of a flexibility of the coverslip 5 and a peeling off characteristic of a plurality of coverslips 5 sticking together.

The slide 8 has the test material 12 to be made into a specimen attached thereonto at latest at an initial stage of a slide transferring process by the test material fixing mechanism, and said attached plane is placed in a state being met with the solvent 11, then the slide 8 is placed on the table stand 9 with the test material attached plane facing upward in a state that the mountant 10 is dropped on such end part of the attached plane as facing the first pushing part 3.

The mountant 10 is adhesive to bond the coverslip 5 to the slide 8, as mentioned above, and fix the test material 12 between said coverslips 5 and slide 8 for protecting the same, and transparent adhesive for example pinene type resin mountant is used therefor. Also, the solvent 11 is to dissolve paraffin, used when the test material 12 is cut into a very thin piece, etc. and at the same time to accelerate uniform spreading of the mountant 10, and for example xylene is used.

In the above-mentioned arrangement, what is different from the mechanism explained in FIG. 1, is that the second pushing part 4 is provided and the adhering part 2 is also made slidable against the main supporting body 1. This is a result of functionally combining the above-mentioned two methods for simultaneously carrying out the two methods by almost one mechanism, and the function thereof is similar to the function described in FIGS. 2 and 3.

Next, an operation of this example shall be explained by FIGS. 7(A) to (K). Of FIGS. 7, the (A) to (E) show a taking out process for the coverslip 5, and (F) and (G) show a transferring process of the coverslip 5, while (H) to (K) show a sealing process of the test material. Also the following explanation of operation is based on an assumption that the main supporting body 1 is to be shifted to up and down, as well as left and right directions.

In an operation of a microscopic specimen preparation device, at a process relating to a mechanism according to the present invention, first the main supporting body 1 shifts to a lateral direction as shown in FIG. 7(A) so that the adhering cup 201 of the adhering part 2 and the pushing body 301 of the pushing part 3 are so controlled that they come to a position directly above the coverslips 5 housed within the housing receptacle 6 in a piled up manner.

Next, as shown in FIG. 7(B), when the main supporting body 1 is made to descend in the direction of the arrow A, the fore end of the pushing body 301 of the first pushing part 3 comes in contact with the uppermost coverslip 5A of the plurality of said coverslips 5 being piled up within the housing receptacle 6, then the adhering cup 201 of the adhering part 2 comes in contact with said uppermost coverslip 5A.

In this operation, after said adhering cup 201 and the pushing body 301 come in contact with the coverslip 5A, the main supporting body 1 further shifts to the direction of the arrow A under a state that the tube 202 of the adhering part 2 and the pushing bar 302 of the first pushing part 3 slide, and the adhering cup 201 and the pushing body 301 touch the coverslip 5A in a pressing state by the springs 302, 303, respectively. Since the adhering plane of the adhering cup 201 and the fore end of the pushing body 301 touch the same plane under this state, the first pushing part 3 protrudes to the direction of the arrow C more than the adhering part 2 does as much as the above-mentioned protruding length X (FIG. 5) (the rotation stop blocks 204 and 304 are separated from the main supporting body 1 and the mutual positional difference therebetween becomes the protruding length X). Also the second pushing part 4 does not shift as the guide roller 405 thereof is checked by the guide slot 7, while the main supporting body 1 descends slidingly along the pushing bar 402, but the position of the pushing body 401 remains unchanged. This pushing body 401 continues the state of position being unchanged until the state shown in FIG. 7(E) is attained.

When the state shown in FIG. 7(B) is attained, the electromagnetic valve connected to the fore end of the tube 14 is opened to the vacuum pump to take out air to the direction of the arrow B, and by this the presssure within the adhering cup 201 becomes smaller than the ambient pressure and the coverslip 5A is adhered to the adhering cup 201. Also, the electromagnetic valve continues to open to the vacuum pump until the state shown in FIG. 7(J) is attained, and the air withdrawal operation from the adhering cup 201 is continued.

As shown in FIG. 7(C), the main supporting body 1 is made to ascend in the direction of the arrow D, and by this the adhering part 2 and the first pushing part 3 shift to the direction of the arrow E against the main supporting body 1 by restoring power of the springs 203, 303, and the rotation stop blocks 204, 304 touch the main supporting body 1, then thereafter go up in the direction of the arrow D together with the main supporting body 1. At this time, the coverslip 5A is adhered to the adhering cup 201 and ascends along with the ascending of the adhering part 2, and one end part thereof is pushed by the pushing body 301 of the pushing part 3, thus said coverslip 5A ascends in an inclined posture (as mentioned above since the adhering cup 201 is made of soft type material, the coverslip 5A will not be separated from the adhering cup 201 even if it is inclined).

Now, during a period of time from the moment the rotation stop block 204 of the adhering part 2 touches the main supporting body 1 until the rotation stop block 304 of the first pushing part 3 touches the main supporting body 1 in the course of shifting from the state of FIG. 7(B) to the state of FIG. 7(C), there will be peeling off effect working on the two stuck coverslips in the same manner as in the abovementioned case of shifting from FIG. 2(C) to FIG. 2(D), but thin plates having smooth surfaces, such as coverslips which adjoin each other, stuck together rather strongly and are in most cases in a state adhering to each other, thus even in the state of FIG. 7(C) after the above-mentioned processes a plurality of coverslips (FIG. 7(C) shows a case where two sheets thereof are taken out) will be taken out in many instances. That is as shown in FIG. 7(C) the adhered coverslip 5A and the coverslip 5B just underneath the coverslip 5A (second from the top) stick together and are simultaneously picked up.

The main supporting body 1 ascends to its original position (the position shown in FIG. 7(A)) under a state that the coverslip 5A is adherently held thereat, and the left end of the adhered coverslip 5A (the opposite end from the end having been pushed by the first pushing part 3) comes in contact with the fore end of the pushing body 401 of the second pushing part 4, then the coverslip 5A is bent in a shape with curvature to the direction of the arrow F. The direction of curvature at this time is opposite to the direction of curvature generated during the course between FIG. 7(B) and FIG. 7(C). As the coverslip 5A which is adhered to the adhering cup 201 is bent in a shape with a curvature, bending force in the direction of the arrow F works on the coverslip 5B being stuck to the coverslip 5A, but the coverslip 5B will not be bent due to its own elasticity (even if somewhat bent, it restores immediately) and tends to remain in a flat shape generating a gap between the upper and lower coverslips 5A and 5B, thus the adhering power therebetween sharply becomes weak, and the coverslip 5B is dropped in the direction of the arrow G and is housed in the housing receptacle 6.

When the main supporting body 1 returns to its original position, only one coverslip 5A will be taken out of the housing receptacle 6 as shown in FIG. 7(E). In this state the inside of the adhering cup 201 is still in a vacuum state (that is a state that the inner pressure is lower than the atmospheric pressure) and the coverslip 5A remains in the state being adhered to the adhering part 2, and is in the state being bent in the direction of the arrow F by a cooperation of the first pushing part 3, the second pushing part 4 and the adhering part 2. The above completes a taking out process of the coverslip, then proceeds to a coverslip transferring process. When it proceeds to the transferring process, the main supporting body 1 is controlled so as to be shifted in the direction of the arrow H as shown in FIG. 7(F) while the adhering part 2 adherently holds the coverslip 5A. At this time, since the guide roller 405 of the second pushing part 4 is shifted and pushed up along the guide slot 7, the entire second pushing part 4 ascends in the direction of the arrow I maintaining its parallel state. Therefore, the pushing force by the pushing body 401 of the second pushing part 4 which has bent the coverslip 5A gradually disappears in the transferring process and the coverslip 5A returns in the direction of the arrow J and resumes its flat shape, then the coverslip 5A is transferred in a state being inclined with a predetermined angle maintained by the pushing body 301 of the first pushing part 3. The main supporting body 1 in this transferring process shifts until the coverslip 5A being adherently held comes to a position above the table stand 9 and stops as shown in FIG. 7(G).

The slide 8 in a state as having the test material 12 being attached thereon and being wet with the solvent 11 also having the mountant 10 dropped thereon will have been placed on the table stand 9 by the time the action shown in FIG. 7(E) is completed at the latest, and the above-mentioned coverslip 5A faces the plane of the slide 8 on which the test material 12 is attached as shown in FIG. 7(G). The above completes the transferring process of the coverslip, then proceeds into a sealing process of the test material 12.

Since the operations afterproceeding into the sealing process are almost same as the operations shown in FIGS. 3(A) to (B), operating patterns are merely shown in FIGS. 7(G) to (K), and description thereof will be omitted.

What is different from the operations shown in FIGS. 3(A) to (E) is the operating pattern shown in FIG. 7(J). That is, when the coverslip 5A closely contacts with the slide 8, it will not be lowered further, but the main supporting body 1 makes further descending movement, and during this descending movement the springs 203 and 303 are compressed and the adhering cup 201 and the pushing body 301 compressingly press the coverslip 5A onto the slide 8 by the compressing force of the springs 203, 303, to assure the sealing of the test material 12.

Another difference from the operations shown in FIGS. 3(A) to (E) is that the adhering part 2 (the adhering cup 201) makes the up and down movements together with the main supporting body 1 after the rotation stop block 204 comes in contact with the main supporting body 1. (In the mechanism shown in FIG. 1, the adhering part 2 is directly installed to the main supporting body 1).

Also the pushing body 401 of the second pushing part 4 ascends to the highest position by the guide slot 7 at the last stage of the transferring process (a state shown in FIG. 7(G), and is fixed to the highest position until the sealing process (a state shown in FIG. 7(K)) is completed.

When the coverslip 5A is released from its adherent holding by the adhering cup 201, and the main supporting body 1 ascends in the direction of the arrow D and stops as shown in FIG. 7(K), the main supporting body 1 is shifted to the direction of the arrow L, and the second pushing part 4 descends along the guide slot 7, thus the state of FIG. 7(A) is resumed, and the above-mentioned operations may be repeated thereafter.

According to a modification of the present invention, the adhering and holding the coverslip may be done by an employment of a sucking disk other than the mechanism by the combination of the adhering cup 201, the electromagnetic valve and the vacuum pump mentioned above. That is, a sucking disk made by forming with soft elastic material (for example silicon rubber, etc.) in a hollow semi-circular shape is used in place of the above-mentioned adhering cup 201, and an air hole is provided penetrating through the hollow part of the sucking disk wherein the air hole is made to be opened and closed by opening and closing means such as an electromagnetic valve, and when the coverslip is adherently held the sucking disk is pressed against the coverslip with the opening and closing means maintained in a closed state for adhering the same, then at the time when the adhered coverslip is released, the above-mentioned opening and closing means is opened to let air come into the hollow portion in the sucking disk to eliminate the adhering force of the sucking disk.

According to the taking out method of coverslips in the present invention, as the coverslip is taken out by bending the coverslip within its elastic limit of the coverslips will not damage each other by friction between themselves. Also even when the coverslips stick together, a slight amount of slip takes place between the coverslip being taken out and the coverslip being stuck thereto by the bending of the former coverslip and they are separated without fail, therefore the coverslip can be taken out one by one without fail.

According to the method of sealing and fixing the test material in the present invention, the coverslip is retained in a slanted manner as the test material to be made into a specimen is sealed, and the coverslip is made to be gradually overlappedly put together with the slide from a part at which the mountant is dropped, and the coverslip is in a bent state at that time making the sealing operation gradually while returning the curved coverslip to its original shape, therefore the restoring force (elasticity) of the coverslip works so as to push out air between the slide and the coverslip, allowing preparation of a microscopic specimen totally free from air bubbles, thus erroneous judgement in a pathological examination can be prevented and at the same time the specimen can be stored for a long period of time.

In a preparing device for a microscopic specimen according to the present invention, the coverslip taking out process, the coverslip transferring process and the sealing process of test material are done by common use of the main mechanism (the main supporting stand 1, the adhering part 2 and the first pushing part 3), therefore the structure and control thereof can be simplified, also as no inter-process shifting time is necessary among individual processes, the time required by the sealing process of test material can be remarkably shortened.

Since the coverslip is so controlled that its curvature is gradually eliminated in the transfer process thereof, breakage troubles, etc. of the coverslips are very rare as compared to a device in which a restoration of a curvature is done rather suddenly by a removal of hooking (checking) means as an example.

What we claim:

1. A method for preparing a microscopic specimen by lifting up coverslips of a sheet shape made of comparatively rigid material from a pile thereof, one by one, comprising:

attractingly holding an uppermost coverslip of the pile on one holding spot on its upper surface and elastically pushing the same on another spot on one end portion of its upper surface spaced apart from the holding spot in a longitudinal direction of the uppermost coverslip;

lifting up the holding spot of the uppermost cover slip and lifting up the pushing spot of the uppermost coverslip with a delay time from said lifting up of said holding spot so as to lift and bend the uppermost cover slip while it is held in an inclined state and within its elastic limit;

pushing an end of the uppermost cover slip at an opposite end thereof to said pushing spot during the lifting of the uppermost coverslip for bending the center portion of the uppermost coverslip within its elastic limit, thereby causing any other coverslip adhering to the uppermost coverslip to be peeled off and dropped; and gradually eliminating the bending afforded to the uppermost coverslip while it is held.

2. A method according to claim 1, in which the uppermost coverslip is held by air-tightly contacting an opening plane of a hollowed cup-like member formed with soft, elastic material onto the uppermost coverslip and withdrawing air contained in said member.

3. A method according to claim 1, in which the uppermost coverslip is held by pushing a sucking disk formed with soft, elastic material onto the uppermost coverslip.

4. A method for preparing a microscopic specimen according to claim 1, further comprising:

dropping a liquid mountant on a slide near a test material carried by the slide;

elastically pushing one end in the longitudinal direction, of a coverslip which is comparatively rigid and is in a sheet shape, and attractively holding said coverslip in a slanted position with respect to a plane of the slide positioning the coverslip and the slide so that they face each other in such a manner that an end part of the coverslip closer to the side thereof corresponds to a spot on the slide at which the mountant has been dropped, and the coverslip plane corresponds to a spot on the slide at which the test material is attached, respectively;

causing the coverslip and the slide to approach each other while maintaining the slanted holding position of the coverslip to have an end part of the coverslip touch the spot on the slide at which the mountant has been dropped;

pressing the end part of the coverslip elastically onto the slide to bend the coverslip within its elastic limit;

gradually eliminating the bend of the coverslip and adhering the coverslip closely to the slide with the mountant placed therebetween; and releasing the holding of the coverslip.

5. A method according to claim 4, in which the coverslip is held by air-tightly contacting an opening plane of a hollowed cup-like member formed with soft, elastic material onto the coverslip and withdrawing air contained in said member.

6. A method according to claim 4, in which the coverslip is held by pushing a sucking disk formed with soft, elastic material onto the coverslip.

7. An apparatus for preparing a microscopic specimen, which comprises: adhesion means reciprocatingly movable in a vertical direction and in a horizontal direction with respect to the plane of a pile of coverslips which are in sheet shape and are comparatively rigid for holding an uppermost coverslip of the pile at a holding point and at a turning point in said reciprocating movement; first pushing means reciprocatingly movable in the same up and down directions as that of said adhesion means for pushing said coverslip being held by said adhesion means at one of its end parts so as to place said coverslip in a slanted state; and second pushing means arranged to be unmovable against the reciprocating movement in the vertical direction of the adhesion means and reciprocatingly movable in the vertical direction with respect to the plane of the pile of the coverslips against the reciprocating movement in the horizontal direction of the same for pushing the coverslip at an opposite end part thereof, so that the holding point of the coverslip by said adhesion means, the pushing point on the coverslip by said first pushing means and the pushing point on the coverslip by said second pushing means change from a state in which they are aligned on a longitudinal cross-sectional plane of the coverslip to a state in which they are not aligned so as to bend the coverslip, while the coverslips are attractedly held and lifted up thereby separating and taking up the uppermost coverslip of the pile of coverslips then upwardly pushing said second pushing means thereby gradually eliminating the bend to the coverslip and the coverslip is pushed onto a surface of a slide by said first pushing means while the coverslip is being held by said adhesion means, thus bending said coverslip in a direction reverse to said first mentioned bend, then the adhesion means is controlled so as to gradually approach the holding point of the coverslip by the adhesion means to the surface of the slide for cementing the coverslip onto the surface of the slide while gradually releasing the curvature thereof.

8. An apparatus according to claim 7, in which said adhesion means is a hollowed cup-like body formed with a soft, elastic material, and containing air therein which is withdrawn by a vacuum pump when it holds the coverslip.

9. An apparatus according to claim 7, in which said adhesion means is a sucking disk formed with a soft, elastic material.

10. A device for removing a rigid coverslip from a pile of rigid coverslips each bendable to an elastic limit, comprising:

a support body;

holding means connected to said support body having a lower end below said support body with an adhesion member for adhering to an upper surface of an uppermost coverslip in the pile of coverslips, said lower end being at a selected level with respect to said support body;

a first pusher bar slidably mounted to said support body and having a lower position, said first pusher bar having a first pusher member at a lower end thereof for engaging against and pushing an upper surface of an uppermost one of the coverslips on the pile of coverslips, said pusher member spaced laterally of said adhesion member by a distance less than a length of a coverslip on the pile of coverslips, said pusher member being at a level below said selected level with said first pusher bar in said lower position;

biasing means for biasing said first pusher bar into said lower position and permitting movement of said pusher bar upwardly with respect to said support body;

a second pusher bar slidably mounted to said support body in a side of said holding means opposite from said first pusher bar, said second pusher bar having a second pusher member at a lower end thereof and being displaceable from a lower position with said second pusher member at a level lower than said selected level, to an upper positon above said selected level, said second pusher bar with second pusher member positioned to engage the upper surface adjacent an edge of an uppermost one of the coverslips on the pile of coverslips opposite a side of the uppermost coverslip engageable by said first pusher member; and means connected to said second pusher bar for moving said second pusher bar between its lower position and raised position whereby said support body can be moved downwardly with respect to an uppermost one of the coverslips to first press said first pusher member against a first spot on an upper surface of the uppermost coverslip, said support body being movable downwardly further to engage said adhesion member against the upper surface of the uppermost coverslip at a second spot near a center of the uppermost coverslip and to cause retraction of said first pusher bar against the bias of said biasing means, said support body being thereafter liftable to raise the uppermost coverslip and cause the uppermost coverslip to bend under the holding influence of said adhesion member and the pushing influence of said first pusher bar, said second pusher bar being movable downwardly against the uppermost cover at a third spot on a side of said second spot opposite said first spot for bending the uppermost coverslip in an opposite direction from said first mentioned bending to cause any additonal coverslip adhered to a bottom of the uppermost coverslip to be dislodged and dropped back onto the pile of coverslips.

11. A device according to claim 10, wherein said second pusher member has a flat bottom surface, said first pusher member being made of resilient elastic material and having a rounded bottom surface, said adhesion head comprising a suction cup.

12. A device according to claim 11, wherein said holding means includes a pipe slidably mounted to said support body and additional biasing means connected to said pipe for biasing said pipe into a lower position for bringing said lower end to said selected level, said suction being connected to a lower end of said pipe.

13. A device according to claim 12, including an additional second pusher bar connected to said second pusher member for holding said flat bottom of said second pusher member parallel with respect to said support body throughout the movement of said first mentioned and further second pusher bars.

* * * * *